US005293010A

United States Patent [19]

Archambault et al.

[11] Patent Number: 5,293,010

[45] Date of Patent: Mar. 8, 1994

[54] SOUND DAMPENING DEVICE FOR HORNS

[75] Inventors: Bruno Archambault, Sherbrooke; Mario Maltais, Stoke; André Albert, Sherbrooke, all of Canada

[73] Assignee: Baultar, Inc., Richmond, Canada

[21] Appl. No.: 25,522

[22] Filed: Mar. 3, 1993

[51] Int. Cl.[5] ..... G10K 11/00

[52] U.S. Cl. ..... 181/179; 181/191; 181/198

[58] Field of Search ..... 181/143, 146, 150, 151, 181/152, 155, 159, 179, 180, 181, 182, 183, 185, 189, 191, 196, 198, 199, 208; 116/137 A, 137 R, 147, DIG. 18, DIG. 19

[56] References Cited

U.S. PATENT DOCUMENTS

| | | | |
|---|---|---|---|
| Re. 32,183 | 6/1986 | Isaacs | 181/185 |
| 4,596,305 | 6/1986 | Jagborn | 181/151 |
| 4,802,551 | 2/1989 | Jacobsen | 181/146 |
| 4,896,134 | 1/1990 | Hayashi | 181/198 X |
| 5,146,434 | 9/1992 | Bromley | 181/143 X |

*Primary Examiner*—Michael L. Gellner
*Assistant Examiner*—Khanh Dang
*Attorney, Agent, or Firm*—Edwin E. Greigg; Ronald E. Greigg

[57] ABSTRACT

The horn housing may comprise an inner metal shell in the shape of a hexagonal box open at one end fitting into a similarly shaped outer dense solid box similarly open at one end. Space between the inner and the outer boxes being filled by a low density sound absorbing filler, and the inner box being connected to the outer box by vibration absorbing bolts. The outer box is mounted to a structure by vibration absorbing mounting brackets. When a high decibel horn or siren is mounted in the inner box to directed sound through the opening, most of the sound propagating sideways towards the structure is absorbed by the housing increasing the comfort level of passengers or crew inside the structure.

7 Claims, 2 Drawing Sheets

SOUND DAMPENING DEVICE FOR HORNS

FIELD OF THE INVENTION

The present invention relates to a horn housing mountable to a structure which directs sound generated by the horn through an opening in the housing and absorbs sound propagating sideways from the horn towards the structure.

BACKGROUND OF THE INVENTION

High decibel horns or sirens are used on trains and ships as a warning that the vehicle is approaching. When the horn is mounted to an outside of the structure in which crew or passengers are located, the sound propagating from the horn as well as the vibration generated by the horn is partially transmitted sideways to the structure and can be disturbing to the crew or passengers after prolonged exposure to the sound or vibration.

Usually, the horns or sirens are mounted to the structure of the vehicle or vessel with some sort of vibration absorbing member to absorb the primary high amplitude mechanical vibrations coming from the horn. Such vibration absorbing mountings serve to prevent damage to the structure as a result of the vibration.

SUMMARY OF THE INVENTION

It is an object of the present invention to provide a horn housing capable of reducing substantially the amount of sound and mechanical vibration emanating from a horn to a structure containing crew or passengers. It is furthermore an object of the present invention to provide a horn housing in which sound emanating from a horn in directions other than a principal direction of the horn is either absorbed or reflected in the principal direction of the horn.

According to the invention, there is provided a horn housing comprising an inner solid horn containing box having an opening at one end, an outer dense solid box having an opening at one end, the outer box containing the inner box, an intermediate low density sound absorbing filler for filling a space between the inner and the outer boxes, means for connecting the inner box to the outer box, the connecting means transmitting little vibration from the inner box to the outer box in a frequency range of the horn, and means for mounting a side of the outer box to a person containing structure, the mounting means transmitting little vibration from the outer box to the structure. In this way, one or more horns can be installed inside the inner box for directing sound through the opening of the inner box and through the opening of the outer box, the housing absorbing most of the sound propagating sideways towards the structure.

BRIEF DESCRIPTION OF THE DRAWINGS

The invention will become better understood by way of the following non-limiting detailed description of a preferred embodiment with reference to the appended drawings in which.

DETAILED DESCRIPTION OF THE PREFERRED EMBODIMENT

Figure 1:
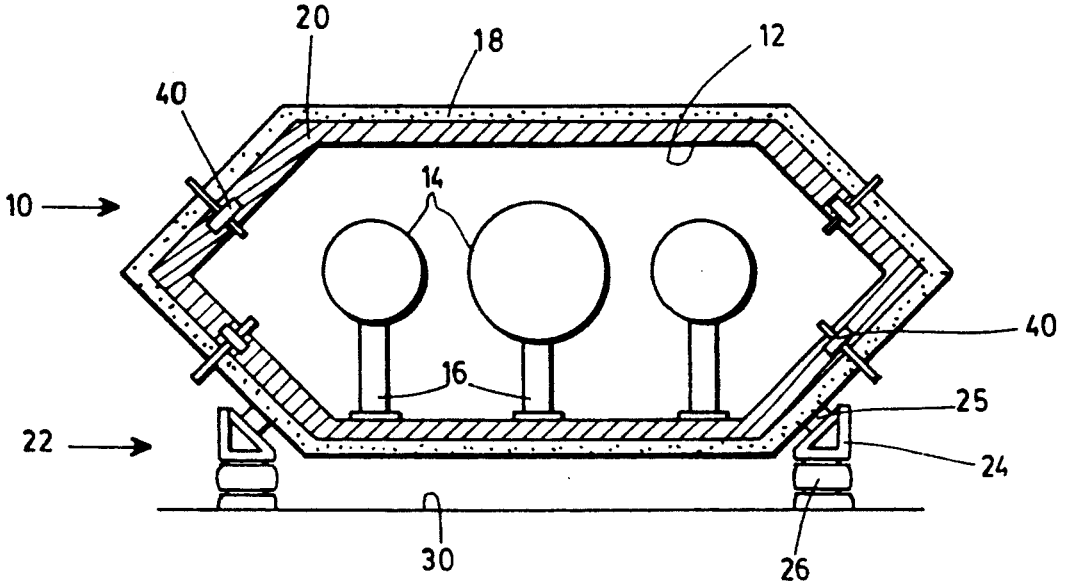
FIG. 1 is a transverse cross-sectional view of the preferred embodiment.
Figure 2:
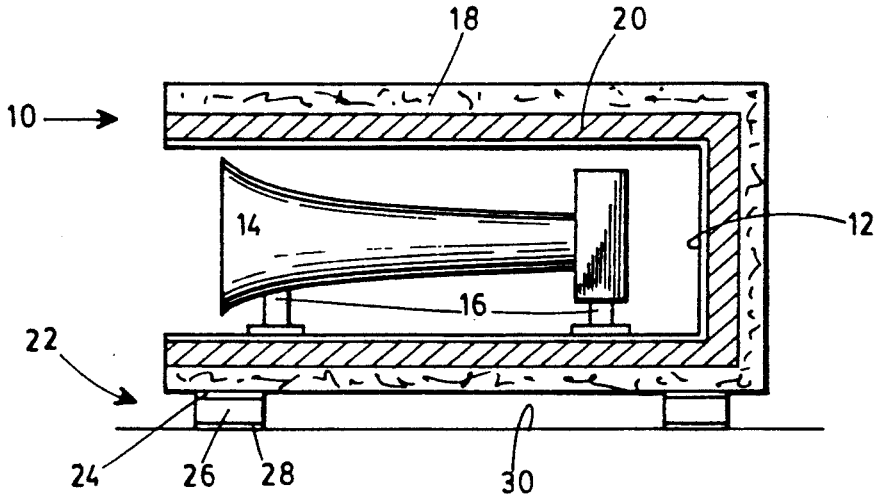
FIG. 2 is a longitudinal cross-section of the preferred embodiment.

With reference to FIGS. 1 and 2, the horn housing (10) according to the preferred embodiment comprises an inner solid shell or box (12) made of stainless steel having a hexagonal cross-section and an opening at one end. Horns (14) are mounted inside box (12). An outer dense solid box (18) is molded from a composite material such as a polymer resin and a filler. The horns (12) are solidly connected to inner box (12) by mounting stems (16) which are welded to box (12). As shown, there may be more than one horn (14) contained within housing (10). Inner box (12) is connected to outer box (18) by means of vibration dampening mounting bolts (40). The space inbetween inner box (12) and outer box (18) is filled with a synthetic filler such as neoprene foam (20) which acts as a good vibration and sound absorber. The outer box (18) is connected to a roof (30) of a train by mounting means (22).

Mounting means (22) comprise a bracket (24) interconnecting rubber pads (25) and (26) between bracket (24) and the outer box (18) and roof top (30) respectively. The vibration dampening mounting bolts (40) are also shown in FIG. 1 to be positioned on the upper and lower side walls of the housing such that the upper bolts (40) lift the inner shell (12) and the lower mounting bolts (40) push up inner shell (12). In the preferred embodiment, there are three bolts (40) per side one bolt at each end of housing (10) on the upper side, and a single bolt in the middle of the side on the lower portion.

Figure 4:
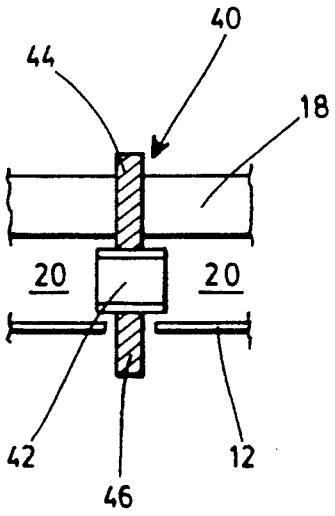
FIG. 4 is a detailed partial cross-sectional view of the connecting means according to the preferred embodiment.

As particularly illustrated in FIG. 4, the vibration dampening mounting bolt (40) according to the preferred embodiment has a vibration absorbing rubber member (42) sandwiched between and fastened to an outer bolt (44) and an inner bolt (46) which fit through holes provided in outer box (18) and inner box (12) respectively. Nuts (not shown) may be fastened to the ends of bolts (44) and (46) to complete the mounting.

Figure 3:
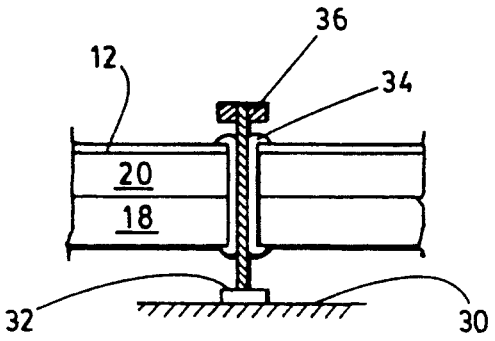
FIG. 3 illustrates a detailed partial cross-sectional view of a safety mounting bolt according to the preferred embodiment.

With reference to FIG. 3, a cross-sectional view of the safety mounting bolt (32) is illustrated which passes through a sleeve (34) provided in the bottom side wall of housing (10). Bolt (32) is bonded to roof top (30), and nut (36) is secured to the end of bolt (32) to provide an additional fastening.

Of course, the rubber pads (25) and (26) can be replaced by vibration dampening bolts (40) in which case, bracket (24) may be bolted to roof (30) and to outer box (18). Preferably, four bolts (40) could be used per mounting (22).

What is claimed is:

1. A horn housing comprising:

an inner solid horn containing metal box having a shape of a prism with an open end and a closed end;

an outer dense solid box molded from a composite material having a shape of a prism with an open end and a closed end, the outer box containing the inner box;

an intermediate low density sound absorbing synthetic filler for filling a space between the inner and the outer boxes;

means for connecting the inner box to the outer box, said connecting means transmitting little vibration from the inner box to the outer box in a frequency range of the horn; and means for mounting a side of the outer box to a structure for housing at least one person, said mounting means transmitting little vibration from the outer box to said structure, whereby at least one horn is installed inside the inner box for directing sound through said opening of the inner box and through said opening of the outer box, said housing absorbing most of said sound propagating sideways towards said structure, whereby sound may be reflected from a wall and said closed end and reflected out through said open end.

2. Housing as claimed in claim 1, wherein said synthetic filler is formed of neoprene.

3. Housing as claimed in claim 1, wherein said connecting means comprise vibration absorbing bolts including a resilient vibration absorbing member interconnecting first and second bolt stems fastenable to said inner box and said outer box respectively.

4. Housing as claimed in claim 3, wherein said inner box and said outer box are hexagonal prisms.

5. Housing as claimed in claim 4, wherein said outer box includes upper side segments and is mounted by said mounting means to said structure with a bottom side wall of said outer box being horizontal, and two said vibration absorbing bolts are provided on each upper side segment of said housing at opposite ends thereof and one said vibration absorbing bolt is provided on opposite sides of said bottom side wall thereof intermediate said open and closed ends.

6. Housing as claimed in claim 5, wherein said mounting means comprise four mounting brackets provided substantially at each corner of said bottom side of said outer box, said mounting brackets being connected to said outer box by means of vibration absorbing members, and said mounting brackets being connected to said structure by means of vibration absorbing members.

7. Housing as claimed in claim 4, wherein said bottom wall is provided with a hole near a central portion thereof for receiving a safety bolt member having upper and lower ends, said lower end to be bonded to said structure, and said upper end for receiving a nut member, whereby additional anchoring of said housing to said structure is provided.

* * * * *